US008857940B2

(12) United States Patent
Hirai

(10) Patent No.: US 8,857,940 B2
(45) Date of Patent: Oct. 14, 2014

(54) LIQUID EJECTION APPARATUS

(71) Applicant: Brother Kogyo Kabushiki Kaisha, Nagoya (JP)

(72) Inventor: Keita Hirai, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/010,298

(22) Filed: Aug. 26, 2013

(65) Prior Publication Data

US 2014/0063103 A1 Mar. 6, 2014

(30) Foreign Application Priority Data

Aug. 31, 2012 (JP) ..... 2012-190776

(51) Int. Cl.
*B41J 2/07* (2006.01)

(52) U.S. Cl.
CPC ..... *B41J 2/07* (2013.01)
USPC ..... 347/14; 347/51; 347/56

(58) Field of Classification Search
USPC ..... 347/9, 12, 14, 17, 40, 44, 51, 56, 76
See application file for complete search history.

(56) References Cited

U.S. PATENT DOCUMENTS

| | | | | |
|---|---|---|---|---|
| 7,384,128 | B2 * | 6/2008 | Sheahan et al. | 347/42 |
| 8,087,757 | B2 * | 1/2012 | Silverbrook | 347/62 |

FOREIGN PATENT DOCUMENTS

| | | | |
|---|---|---|---|
| JP | 2000-185403 | A | 7/2000 |
| JP | 2001-105584 | A | 4/2001 |
| JP | 2004-098579 | A | 4/2004 |
| JP | 2009-274461 | A | 11/2009 |
| JP | 2011-152742 | A | 8/2011 |

* cited by examiner

*Primary Examiner* — Thinh Nguyen
(74) *Attorney, Agent, or Firm* — Merchant & Gould PC

(57) ABSTRACT

A liquid ejection apparatus includes a liquid ejection head including a plurality of ejection opening groups each constituted by two or more ejection openings and each forming one pixel by at least two liquid droplets ejected from the two or more ejection openings of a corresponding one of the plurality of ejection opening groups; a plurality of individual channels respectively connecting the plurality of ejection opening groups to a plurality of pressure chambers; and an energy-applying portion applying energy to liquid in the plurality of pressure chambers, and a controller controlling the energy-applying portion. The controller controls the energy-applying portion to form one pixel by using at least a first drive signal whose ejection period is a first ejection period and a second drive signal whose ejection period is a second ejection period different from the first ejection period.

9 Claims, 9 Drawing Sheets

FIG.9

| DIAMETER OF EJECTION OPENING [μm] | p [μm] | D [μm] | p/D | T/Ta | | | | | | | | | | MAXIMUM-MINIMUM DIFFERENCE OF TOTAL AMOUNT OF SHIFTS y [μm] |
|---|---|---|---|---|---|---|---|---|---|---|---|---|---|---|
| | | | | 0.85 | 0.90 | 0.94 | 0.98 | 1.02 | 1.06 | 1.10 | 1.15 | 1.19 | 1.23 | |
| | | | | TOTAL AMOUNT OF SHIFTS ($y=y_1+y_2$) [μm] | | | | | | | | | | |
| 12.8 | 34 | 34.3 | 0.99 | 2.1 | −1.1 | −3.1 | 0.9 | 4.0 | 3.9 | 4.8 | 3.2 | −2.6 | −5.1 | 10.0 |
| 12.7 | 37 | 34.2 | 1.08 | 9.0 | 9.3 | 3.7 | 6.1 | 14.1 | 13.1 | 13.3 | 8.7 | 7.4 | 7.0 | 10.3 |
| 12.8 | 40 | 34.2 | 1.17 | 5.2 | 4.3 | −0.8 | 2.6 | 6.9 | 5.1 | 7.1 | 1.4 | 1.3 | 5.6 | 7.8 |
| 12.6 | 50 | 34.0 | 1.47 | 8.0 | 6.2 | 2.4 | 3.6 | 7.7 | 6.6 | 6.5 | 3.8 | 4.2 | 4.8 | 5.6 |
| 13.6 | 34 | 35.1 | 0.97 | 4.1 | 3.3 | −6.4 | −3.1 | 4.1 | 1.7 | 2.2 | 1.2 | −5.8 | −4.9 | 10.6 |
| 13.4 | 37 | 34.9 | 1.06 | 4.5 | 3.7 | 1.5 | 2.6 | 8.0 | 10.2 | 9.9 | 6.1 | 1.3 | 0.3 | 9.9 |
| 13.5 | 40 | 35.0 | 1.14 | 4.9 | 4.9 | 4.0 | 6.4 | 11.4 | 9.6 | 9.8 | 6.4 | 5.9 | 6.3 | 7.4 |
| 13.4 | 50 | 34.8 | 1.44 | 4.4 | 4.1 | 2.9 | 4.1 | 7.5 | 6.5 | 6.0 | 4.6 | 3.7 | 4.5 | 4.6 |
| 14.2 | 40 | 35.7 | 1.12 | 3.8 | 5.2 | 3.9 | 7.7 | 25.3 | 22.0 | 18.2 | 11.6 | 7.3 | 4.3 | 21.5 |
| 14.6 | 60 | 36.1 | 1.66 | −0.2 | −0.2 | −0.5 | 0.9 | 3.6 | 3.2 | 1.6 | 1.5 | −0.4 | −1.0 | 4.5 |
| 14.4 | 80 | 35.8 | 2.23 | 0.3 | 2.7 | 1.2 | 1.4 | 2.2 | 1.9 | 1.1 | 0.2 | 0.7 | 1.5 | 2.5 |
| 14.4 | 100 | 35.9 | 2.79 | 0.2 | 0.3 | 0.0 | −0.6 | −2.3 | −2.3 | −1.4 | 0.0 | −1.6 | −1.2 | 2.7 |

LIQUID EJECTION APPARATUS

CROSS REFERENCE TO RELATED APPLICATION

The present application claims priority from Japanese Patent Application No. 2012-190776, which was filed on Aug. 31, 2012, the disclosure of which is herein incorporated by reference to its entirety.

BACKGROUND OF THE INVENTION

1. Field of the Invention

The present invention relates to a liquid ejection apparatus which ejects liquid such as ink or the like.

2. Description of Related Art

There is known a liquid ejection apparatus which includes a recording head having a plurality of ink channels each of which has two nozzle holes.

SUMMARY OF THE INVENTION

The inventor of the present invention found that, in a case where two or more ejection openings were disposed with respect to one individual channel, respective liquid droplets ejected from the two or more ejection openings flew in directions away from each other. The above-mentioned difference between the directions in which the respective liquid droplets fly causes poor quality of an image formed by the liquid droplets.

It is therefore an object of the present invention to provide a liquid ejection apparatus, in a case where there are disposed a plurality of individual channels each of which has two or more ejection openings, to restrain degrading in image quality due to difference between directions in which the liquid droplets fly.

In order to achieve the above-mentioned object, according to the present invention, there is provided a liquid ejection apparatus comprising: a liquid ejection head including: a plurality of ejection opening groups each constituted by two or more ejection openings and each configured to form one pixel by at least two liquid droplets ejected from the two or more ejection openings of a corresponding one of the plurality of ejection opening groups; a plurality of individual channels configured to respectively connect the plurality of ejection opening groups to a plurality of pressure chambers; and an energy-applying portion configured to apply energy to liquid in the plurality of pressure chambers such that the liquid droplets are ejected from at least one ejection opening group selected among the plurality of ejection opening groups, and a controller configured to control the energy-applying portion, wherein, in a case where a first recording period is defined as a time period required for a recording medium to move relatively to the liquid ejection head by a unit length corresponding to resolution of an image recorded on the recording medium, the controller controls the energy-applying portion to form one pixel by using at least (a) a first drive signal in which an ejection period of the liquid droplets ejected in the first recording period is a first ejection period, and (b) a second drive signal in which an ejection period of the liquid droplets ejected in the first recording period is a second ejection period different from the first ejection period.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which:

FIG. 7A is a graph showing a relation between T/Ta and a total amount of shifts y of ink droplets in a plurality of heads different in p/D from each other; and FIG. 7B is a graph showing a relation between p/D and a maximum−minimum difference of the total amount of shifts y (a maximum−a minimum);

FIG. 8A is a graph showing a relation between T/Ta and a total amount of shifts y of ink droplets in a head of $p/D \leq 1.2$; FIG. 8B is a graph showing a relation between T/Ta and a total amount of shifts y of ink droplets in a head of $p/D > 1.2$; and FIG. 9 is a table showing measurement results of the specific example of the present invention.

DETAILED DESCRIPTION OF THE PREFERRED EMBODIMENTS

Figure 1:
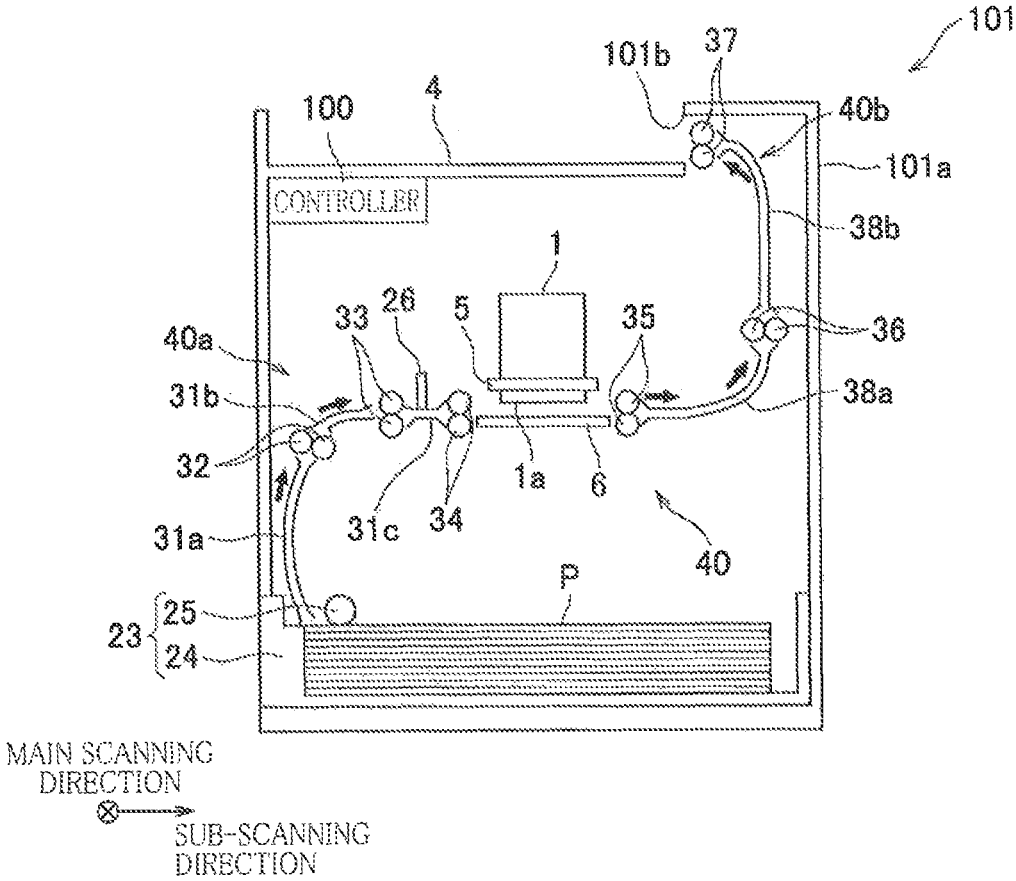
FIG. 1 is a schematic side view showing an internal structure of an inkjet printer as one embodiment to which the present invention is applied.

Hereinafter, there will be described preferred embodiments of the invention with reference to the drawings.

There will be described an overall structure of an inkjet printer 101 as one embodiment to which the present invention is applied with reference to FIG. 1.

The printer 101 includes a casing 101*a* having a rectangular parallelepiped shape. In an upper portion of a top panel of the casing 101*a*, there is disposed a sheet-discharge portion 4. In an inner space of the casing 1*a*, there are disposed a head 1, a platen 6, a sheet sensor 26, a feeding unit 40, a controller 100, and so on. A feeding path through which a sheet P is fed is formed along a thick arrow in FIG. 1 from the sheet-supply unit 23 in a lower portion of the casing 101*a* to the sheet-discharge portion 4.

The head 1 is a line-type head having a generally rectangular parallelepiped shape extending in a main scanning direction (a direction perpendicular to a sheet plane of FIG. 1). A lower surface of the head 1 is an ejection surface 1*a* to which a plurality of ejection openings 108 open (shown in FIG. 2B). The head 1 is supported by the casing 101*a* through a holder 5. There is formed a predetermined clearance between the ejection surface 1*a* and a(n upper) surface of the platen 6.

The head 1 has a laminar structure which includes a head main body 3 (shown in FIG. 2A), a reservoir unit, a flexible printed circuit board (FPC), a circuit board, and so forth that are stacked on each other. The circuit board adjusts signals inputted from the controller 100 and outputs the adjusted signals to a driver IC on the FPC. The driver IC converts the adjusted signals to drive signals and transmits the drive signals to respective electrodes of an actuator unit 21. When the actuator unit 21 is driven based on the drive signals, ink in the reservoir unit is supplied to the head main body 3 so as to be ejected as ink droplets from the ejection openings 108. More detailed structure of the head 1 will be described later.

The platen 6 is a flat plate and has a rectangular shape slightly larger than the ejection surface 1*a* as seen in a direction perpendicular to the ejection surface 1*a*. The platen 6 is opposed to the ejection surface 1*a* and there is formed a predetermined space suitable for recording between the platen 6 and the ejection surface 1*a*.

The sheet sensor 26 is disposed upstream of the head 1 in a feeding direction and detects a leading end of the sheet P. The feeding direction is a direction in which the sheet P is fed by the feeding unit 40. Detection signals outputted from the sheet sensor 26 are inputted to the controller 100.

The feeding unit 40 includes an upstream feeding portion 40*a* and a downstream feeding portion 40*b* between which the platen 6 is disposed. The upstream feeding portion 40*a* includes guides 31*a*, 31*b*, 31*c* and pairs of rollers 32, 33, 34. The downstream feeding portion 40*b* includes guides 38*a*, 38*b* and pairs of rollers 35, 36, 37. Respective ones of the pairs of rollers 32 through 37 are driving rollers that are rotated by driving of a feeding motor 40M (shown in FIG. 4) under the control of the controller 100. The others of the pairs of rollers 32 through 37 are driven rollers that are driven with the driving rollers. Each pair of the guides 31*a* through 31*c*, 38*a*, 38*b* are formed of a pair of plate that are opposed to each other.

The sheet-supply unit 23 includes a sheet-supply tray 24 and a sheet-supply roller 25. The sheet-supply tray 24 is detachably attached to the casing 101*a*. The sheet-supply tray 24 is a box-like structure opening upward and can accommodate a plurality of sheets P. The sheet-supply roller 25 is rotated by driving of a sheet-supply motor 25M (shown in FIG. 4) under the control of the controller 100 so as to supply an uppermost one of the sheets P in the sheet-supply tray 24.

Figure 4:
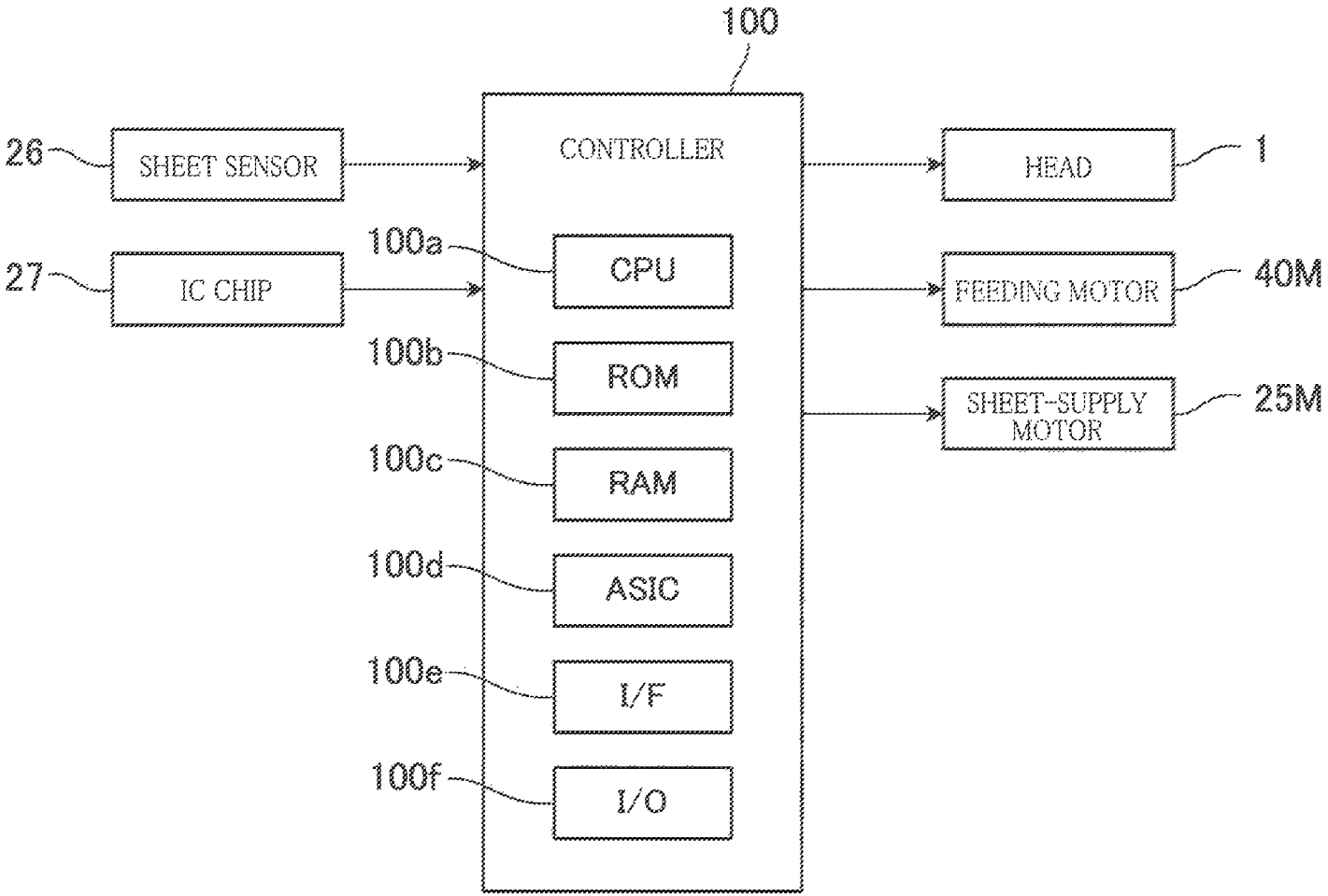
FIG. 4 is a block diagram showing an electrical structure of the printer.

As shown in FIG. 4, the controller 100 includes, in addition to a CPU (Central Processing Unit) 100*a* as an arithmetic processing unit, a ROM (Read Only Memory) 100*b*, a RAM (Random Access Memory: including a nontransitory RAM) 100*c*, an ASIC (Application Specific Integrated Circuit) 100*d*, an I/F (Interface) 100*e*, an I/O (Input/Output Port) 100*f*, and so on. The ROM 100*b* stores programs that are executed by the CPU 100*a*, various fixed data, and so forth. The RAM 100*c* temporarily stores data (image data and so on) necessary when executing of the programs. In the ASIC 100*d*, rewriting, sorting of image data and so on (e.g., signal processing and image processing) are performed. The I/F 100*e* transmits and receives data to and from an external device, e.g., a PC (Personal Computer) connected to the printer 101. The I/O 100*f* performs input/output of detection signals of various sensors. The controller 100 may not include the ASIC 100*d* and rewriting, sorting of image data and so on may be performed by programs and the like that are executed by the CPU 100*a*.

Based on recording command from the external device, the controller 100 controls preparatory operations related to recording, supplying, feeding and discharging operations of the sheet P, ejection of ink droplets that is synchronized with the feeding of the sheet P, and so forth such that an image is recorded on the sheet P. The sheet P supplied from the sheet-supply unit 23 is nipped by the pair of rollers 32 through 37 and guided by the guides 31*a* through 31*c*, 38*a*, 38*b* so as to be fed to the sheet-discharge portion 4. Upstream of the head 1 in the feeding direction on the way to the sheet-discharge portion 4, the sheet sensor 26 detects the leading end of the sheet P. When the sheet P passes right below the head 1, while a (back or lower) surface of the sheet P is supported by the platen 6, an image is recorded on the other (an upper) surface of the sheet P. When recording, the head 1 is driven by the control of the controller 100. The ejection of ink droplets from the ejection openings 108 starts based on the detection signal from the sheet sensor 26 and is performed based on image data. The sheet P on which the image has been recorded is discharged from an opening 101*b* formed in an upper portion of the casing 101*a* to the sheet-discharge portion 4.

Hereinafter, a structure of the head 1 will be described in detail with reference to FIGS. 2A, 2B and 3A, 3B.

Figure 2A:
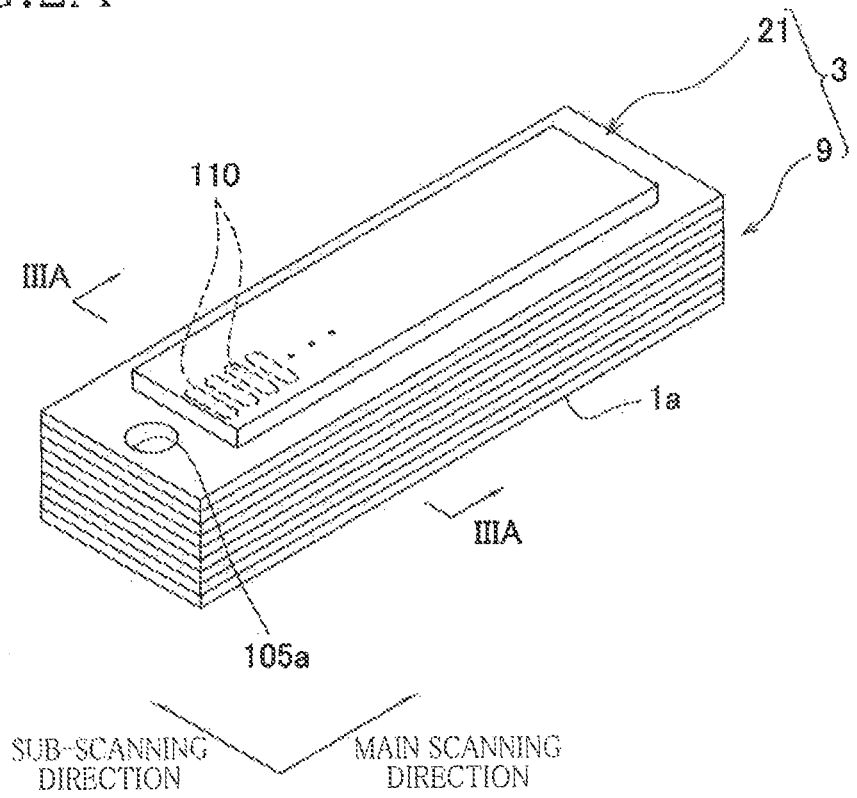
FIG. 2A is a perspective view schematically showing a head main body of a head of the inkjet printer shown in FIG. 1.

As shown in FIG. 2A, the head main body 3 includes a channel unit 9 and the actuator unit 21, and has a generally rectangular parallelepiped shape extending in the main scanning direction.

Figure 3A:
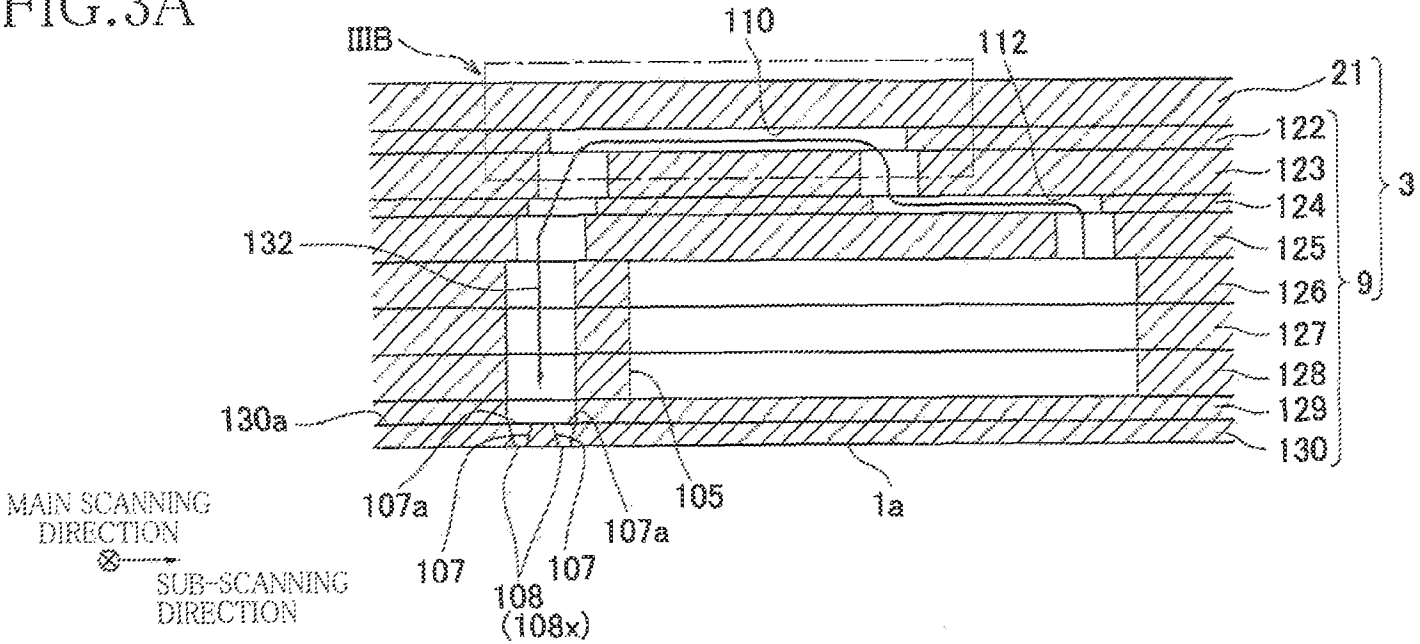
FIG. 3A is a cross-sectional view taken along a line IIIA-IIIA in FIG. 2A.

As shown in FIGS. 2A and 3A, the channel unit 9 has a laminar structure which includes rectangular metallic plates 122, 123, 124, 125, 126, 127, 128, 129, 130 having generally the same size and that are stacked on each other. As shown in FIG. 2A, at an upper surface of the channel unit 9, there are formed one supply opening (an inlet) 105*a* and respective openings of a plurality of pressure chambers 110. The openings of the plurality of pressure chambers 110 are aligned in the main scanning direction. As shown in FIG. 3A, a manifold channel 105 and a plurality of individual channels 132 are formed in the channel unit 9. The manifold channel 105 has the supply opening 105*a* on one of opposite ends thereof and is connected to the plurality of individual channels 132. The manifold channel 105 extends in the main scanning direction. Each of the individual channels 132 extends from an outlet of the manifold channel 105 via an aperture 112 functioning as a throttle valve for adjusting a channel resistance and the pressure chamber 110 to an ejection opening group 108*x*. A lower surface of the channel unit 9 is the ejection surface 1*a*.

Figure 2B:
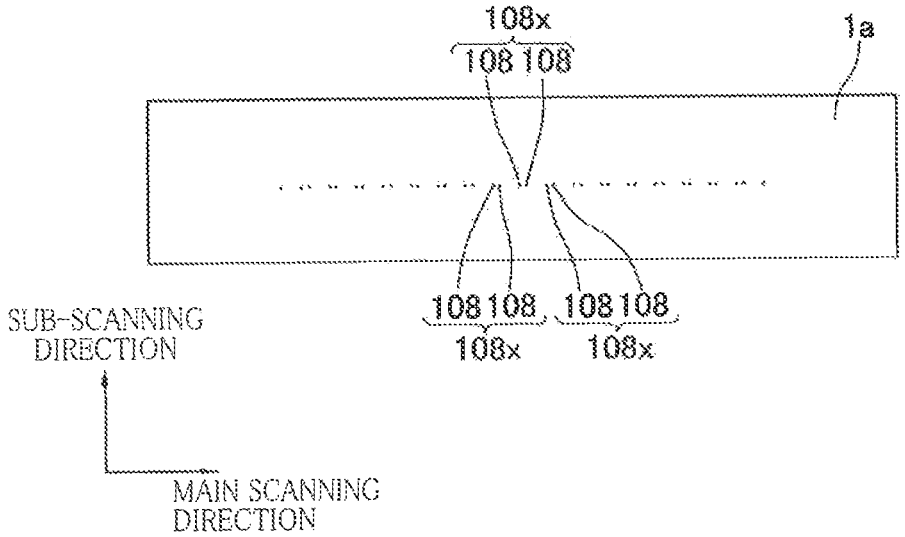
FIG. 2B is a plan view of an ejection surface of the head.

The ejection opening group 108, as shown in FIG. 2B, is constituted by two ejection openings 108 adjacent to each other in the main scanning direction. A plurality of ejection opening groups 108 are disposed at equal intervals in the main scanning direction. One ejection opening group 108*x* and one pressure chamber 110 are connected to each other through one individual channel 132. Ink droplets are simultaneously ejected from two ejection openings 108 constituting each ejection opening group 108*x* such that one pixel is formed by the ink droplets. Pixels are composing elements for forming an image recorded on the sheet P, and are arranged like a matrix corresponding to an image recording area on the sheet P.

A lowermost layer of the channel unit 9 is a nozzle plate 130 in which the ejection openings 108 are formed, and a lower surface of the nozzle plate 130 is the ejection surface 1*a*. A plurality of nozzle holes 107 penetrate through the nozzle plate 130 and connect the ejection openings 108 to openings 107*a* formed at an upper surface 130*a* of the nozzle plate 130. As seen in a plan view of the nozzle plate 130 (the channel unit 9), the ejection opening 108 and the opening 107*a* are coaxial and each has a circular shape, and the opening 107*a* includes the ejection opening 108. In other words, the nozzle hole 107 has a taper shape so as to be tapered off from the opening 107*a* to the ejection opening 108 as seen in a direction parallel to the ejection surface 1*a*.

The reservoir unit is fixed to the upper surface of the channel unit 9. In the reservoir unit, there is formed a reservoir which temporarily stores ink. Ink is supplied from a cartridge (not shown) to the reservoir. Ink in the reservoir is supplied to the channel unit 9 through the supply opening 105*a*.

As shown in FIG. 2A, the actuator unit 21 is fixed to the upper surface of the channel unit 9. The actuator unit 21 has a rectangular shape extending in the main scanning direction as seen in a direction perpendicular to the ejection surface 1*a*, and seals openings of all pressure chambers 110 so as to form a side wall of the pressure chamber 110.

Figure 3B:
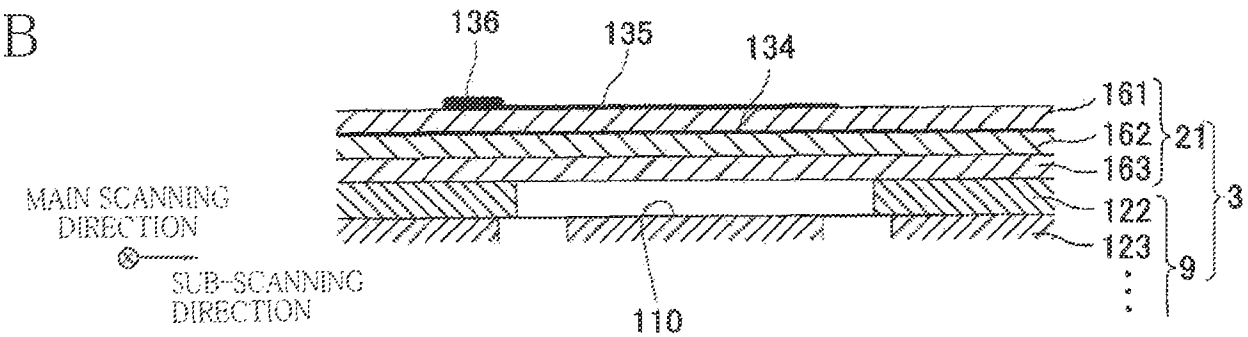
FIG. 3B is an enlarged view showing an area IIIB enclosed by a one-dot chain line in FIG. 3A.

As shown in FIG. 3B, the actuator unit 21 includes three piezoelectric layers 161, 162 163, individual electrodes 135 and a common electrode 134. Each of the piezoelectric layers 161, 162, 163 is formed of ferroelectric lead zirconate titanate (PZT) ceramics, and covers all pressure chambers 110. The individual electrodes 135 are disposed on an upper surface of the piezoelectric layer 161 corresponding to each pressure chamber 110. The common electrode 134 extends between the piezoelectric layers 161, 162 so as to cover all pressure chambers 110. Each individual electrode 135 has an opposing portion opposed to the corresponding pressure chamber 110 and non-opposing portion not opposed to the corresponding pressure chamber 110. A land 136 is formed in the non-opposing portion of each individual electrode 135. The land 136 is connected to a terminal of the FPC, not shown.

The piezoelectric layer 161 is polarized in its thickness direction and has an active portion interposed between the individual electrode 135 and the common electrode 134. The active portion is displaced in at least one (in the present embodiment, $d_{31}$) selected among three oscillation modes $d_{31}$, $d_{33}$, $d_{15}$. Portions of the piezoelectric layers 162, 163 opposed to the active portion are non-active portions. In other words, the actuator unit 21 includes unimorph-type piezoelectric actuators each having a laminar structure in which one active portion and two non-active portions for each pressure chamber 110 are stacked on each other. When electric field is applied to the active portion in a direction of polarization, the active portion shrinks in a direction perpendicular to the direction of polarization (in a planar direction of the piezoelectric layer 161). Since a difference in deformation between the active portion and the non-active portion occurs, the actuator deforms in a convex manner toward the pressure chamber 110 (a unimorph deformation). Accordingly, each actuator is independently deformable. Drive modes of the actuators and ejection states of ink droplets according to the drive modes will be described in detail later.

Figure 5:
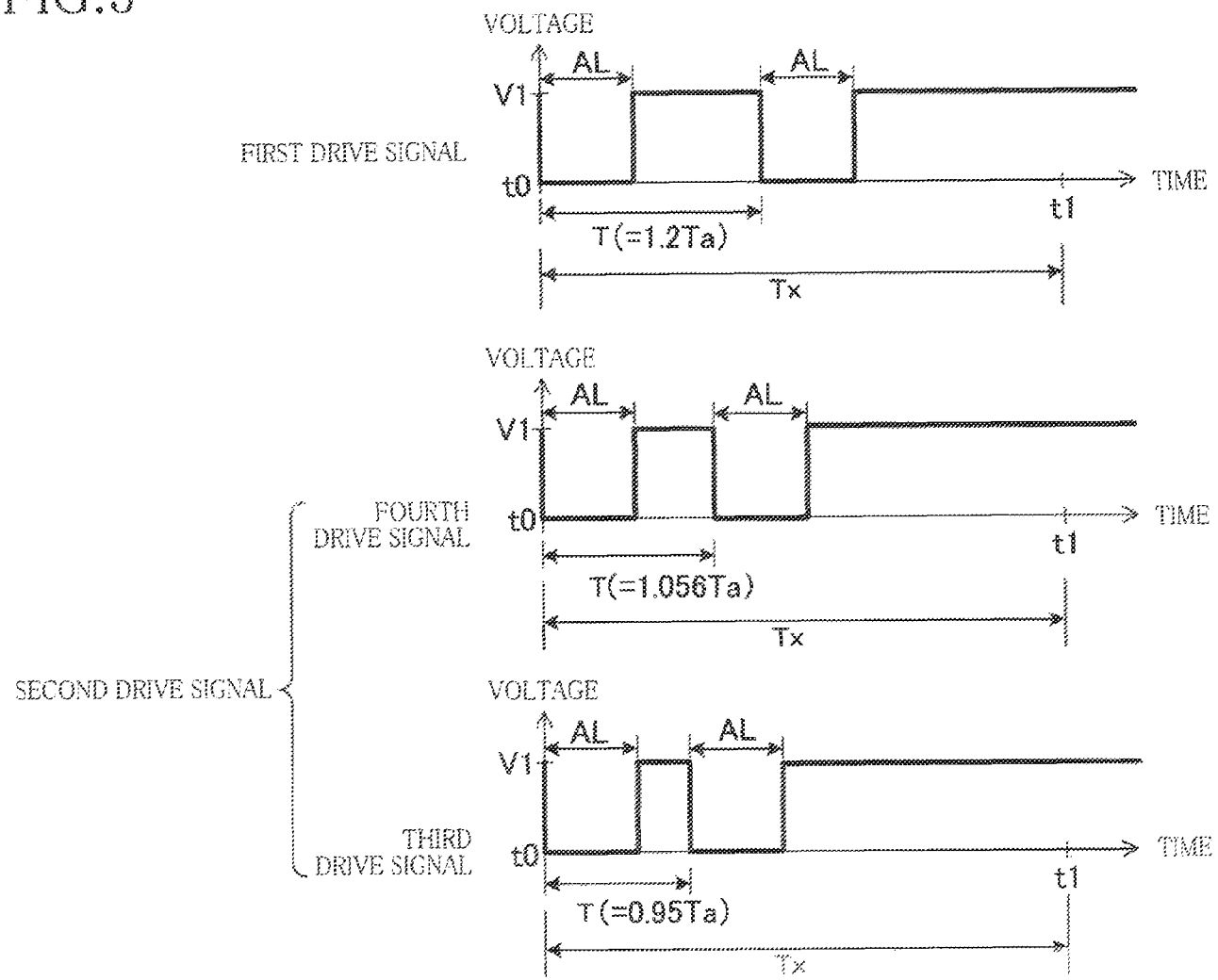
FIG. 5 is a graph showing three drive signals used for driving of an actuator unit in a case where an amount of ink forming one pixel is medium.

Hereinafter, drive signals used for the drive of the actuator unit 21 will be described with reference to FIG. 5.

In a case of $p/D \leq 1.2$, i.e., in a case of p/D is equal to or smaller than 1.2 (p: a distance between respective centers of the two ejection openings 108 constituting the ejection opening group 108*x* on the ejection surface 1*a*; D: a diameter of the opening 107*a* on the upper surface 130*a*), shown in FIG. 6A, when an area of an image other than edges thereof (what is called, a solid area or a gradation area, and so on) is formed or recorded, the controller 100, for each pixel, randomly selects one of three drive signals having respective three ejection periods T different from each other for one ejection and controls the actuator unit 21 by using the drive signal.

The ejection period T means a period of ink ejections within one recording period Tx and is appearance pitch of voltage pluse. The three drive signals, for example, in a case where an amount of ink droplets forming one pixel is medium, are shown in FIG. 5. Each of the three drive signals is composed of two pulses, and the three drive signals are different from each other in periods of the pulses. More specifically, in a case where a resonance period of the individual channel 132 is Ta, T=1.2Ta in a first drive signal, T=1.056Ta in a fourth drive signal, and T=0.95Ta in a third drive signal. The third drive signal and the fourth drive signal are generally called a second signal. In other words, the second drive signal includes the third drive signal and the fourth drive signal. The recording period Tx means a time period necessary for moving of the sheet P relative to the head 1 by a unit distance corresponding to resolution of an image recorded on the sheet P. In the horizontal axis of FIG. 5, t0 is a start time point of the recording period Tx and t1 is an end time point of the recording period Tx. In the present embodiment, the time point t0 also means a start time point of the ejection period T. A case where an amount of ink droplets forming one pixel is large is the same as the case where an amount of ink droplets forming one pixel is medium, except that composing pulse number of each of the drive signals is three. In a case where an amount of ink droplets forming one pixel is small, drive signals having different ejection periods are not set.

The drive signals change a potential of the individual electrode 135 between a ground potential (0V) and a high potential V1 (>0V). The common electrode 134 always stays at the ground potential. In any of the drive signals, durations of voltage pulses (rectangular and pulsed change in voltage from fall to rise of voltage) are constant and are equal to the AL (Acoustic Length: a one-way propagation time of pressure wave in the individual channel 132.

In the present embodiment, as a drive method of the actuator, what is called "fill-before-fire method" is adopted, in which ink is supplied to the pressure chamber 110 before ejection of ink droplets. More specifically, the individual electrode 135 is previously kept at the high potential V1 such that the actuator is deformed in a convex manner toward the pressure chamber 110. Then, when a potential of the individual electrode 135 is changed to the ground potential at a predetermined timing, the actuator is changed from the convex state toward the pressure chamber 110 to a state parallel to the ejection surface 1*a* so as to increase a volume of the pressure chamber 110. Accordingly, ink is supplied into the pressure chamber 110. Then, when the potential of the individual electrode 135 is changed again to the high potential V1 at a predetermined timing, the actuator is changed from the state parallel to the ejection surface 1*a* to the convex state toward the pressure chamber 110 so as to decrease the volume of the pressure chamber 110. Accordingly, pressure (ejection energy) is applied to the ink in the pressure chamber 110 such that ink droplets are simultaneously ejected from the two ejection openings 108 of the corresponding ejection opening group 108*x*.

In the present embodiment, there are four gradation levels such as zero, small, medium and large, and ink amounts for forming one pixel increase in this order. Numbers of times of ejection movement (a series of movement composed of the ink supply and the ejection of ink droplets or a number of ejection for one pixel) are zero, one, two and three times corresponding to the four gradation levels of zero, small, medium and large. One ejection movement corresponds to one voltage pulse. Except a case of the gradation level of zero, as the last drive signal, a pulse for suppressing vibration (a cancel pulse) may be added after the last voltage pulse, so that residual vibration is suppressed.

Data on the drive signals are stored in the ROM 100*b*. Each of the values of p, D, Ta is stored in an IC chip 27 that is mounted in the head 1, and is read out by the controller 100 when the power is on and temporarily stored in the RAM 100*c*. The IC chip 27 is an output means for outputting the values p, D corresponding to the request of the controller 100. The controller 100, in the image forming, acquires the values p, D by accessing the RAM 100*c*. As an output means, input keys by a user for inputting the values p, D may be used. The input keys output signals corresponding to the values p, D to the controller 100. Further, the controller determines whether p/D≤1.2 (p/D is equal to or smaller than 1.2) based on the acquired values p, D. In a case of p/D≤1.2, when an area of an image except edges thereof is formed, the controller 100, for each pixel, randomly selects one of a plurality of drive signals stored in the ROM 100*b* for each ejection and controls the actuator unit 21 by using the drive signal.

Figure 6A:
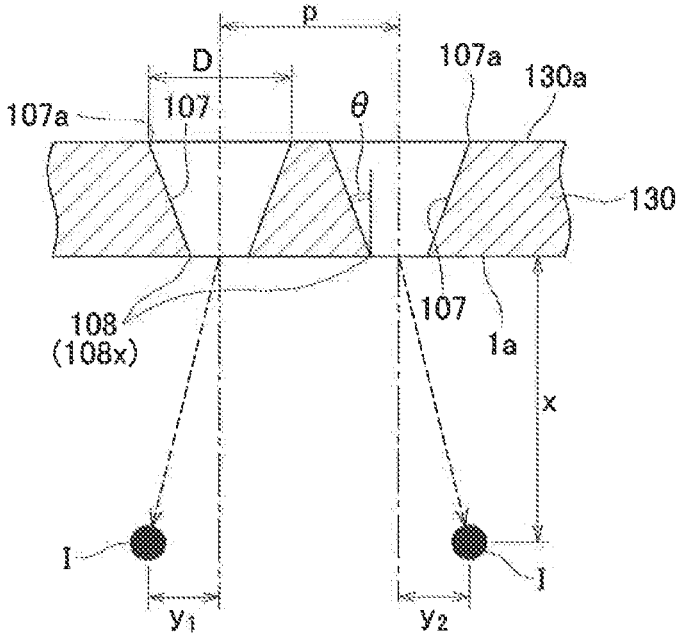
FIG. 6A is a cross-sectional view showing a nozzle plate including two nozzle holes constituting an ejection opening group and showing a state in which ink droplets ejected from two ejection openings of the ejection opening group fly in a direction away from each other.
Figure 6B:
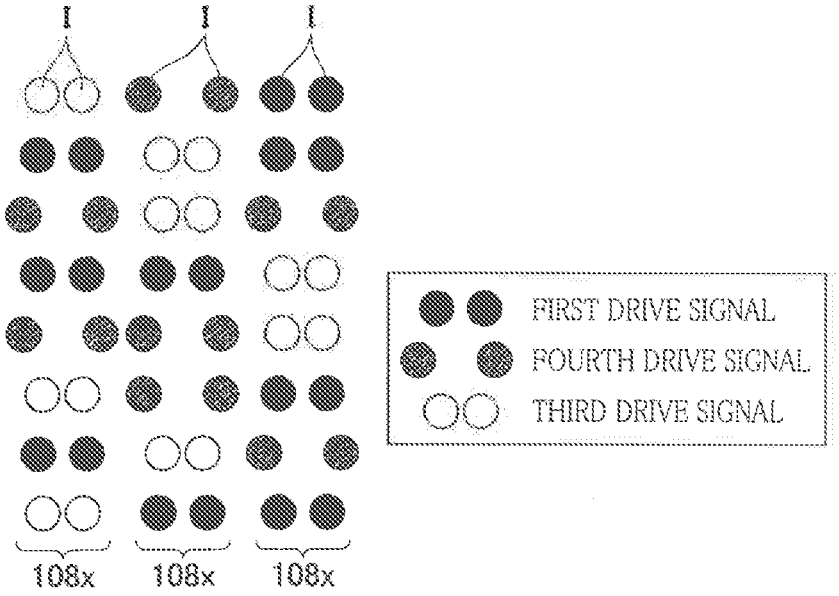
FIG. 6B is a perspective view showing respective positions where the ink droplets land on a sheet, the ink droplets being ejected from respective ejection openings corresponding to ejection opening groups by randomly using the three drive signals showing in FIG. 5.

While, in a case of one ejection opening 108, the ink droplet I flies along a line of axis of the nozzle hole 107, in a case where there are two ejection openings 108, as shown in FIG. 6A, the ink droplets I fly in directions away from each other. These ink droplets I are positioned, at a distance x from the ejection surface 1*a*, at respective positions shifted from desired positions by amounts of shift y1, y2. Here, it is assumed that the amounts of shift y1, y2 of the ink droplets I respectively ejected from the two ejection openings 108 are nearly equal to each other. The amounts of shift y1, y2 are respectively amounts of shift from imaginary lines passing respective centers of the ejection openings 108 and perpendicular to the ejection surface 1*a*.

As described later in a specific example, in the case of p/D≤1.2, in a case where the first drive signal (T=1.2Ta) is used, the ink droplet I is positioned at the position shifted by the amount of shift y1 corresponding to the value of p/D. In a case where the third drive signal (T=0.95Ta) is used, the ink droplet I is positioned at the position shifted by the amount of shift y3 that is smaller than y1. On the other hand, in a case where the fourth drive signal (T=1.056Ta) is used, the ink droplet I is positioned at the position shifted by the amount of shift y4 that is larger than y1. In FIG. 5, the stored drive signals in the case where the amount of ejection ink is medium are shown. The controller 100 randomly selects these drive signals to form each of pixels in an image-forming area except edges. In order to form each of pixels in the edges, the first drive signal is selected for each ejection.

As described above, in the present embodiment, since directions in which the ink droplets fly (the total amount of shifts y) change depending on the ejection periods T as described later in the specific example, by using the plurality of drive signals different in the ejection periods T from each other, the directions in which the ink droplets fly are changed such that lines, unevenness and so forth on an image can be restrained. In other words, the present embodiment, in the case of the plurality of individual channels 132 each of which has two ejection openings 108, can restrain image quality from being degraded due to shifts of the directions in which the ink droplets fly.

The controller 100, when the area of image other than the edges is formed, controls the actuator unit 21 by using the plurality of drive signals for each pixel. In this structure, the edges of image are formed by using one kind of a drive signal (e.g., the first drive signal) so as to make the edges sharp, and also, the area of image other than the edges is formed by using the plurality of drive signals, so that losing in image quality caused by the lines, unevenness and so forth can be restrained.

The controller 100, in the case of p/D≤1.2, controls the actuator unit 21 by using the plurality of drive signals for each pixel. In this structure, degradation in image quality due to the shifts of the directions in which the ink droplets fly can be more effectively restrained.

The plurality of drive signals include the first drive signal, where 0.85Ta≤T≤0.9Ta or 1.2 Ta≤T is met, and the second drive signal, where 0.9Ta<T<1.2Ta is met. In this structure, by using the first drive signal and the second drive signal that are different from each other in the total amount of shifts y of ink droplets in the flying directions of ink droplets, the flying directions of ink droplets can be changed and lines and unevenness on an image can be certainly restrained. In other words, in this structure, degrading in image quality due to the shifts of ink droplets in the flying directions of ink droplets can be certainly restrained.

The second drive signal includes the third drive signal, where 0.9Ta<T≤0.98Ta is met, and the fourth drive signal, where 0.98Ta<T<1.2Ta is met. Therefore, the directions in which ink droplets fly can be widely changed. In this structure, causes of degrading in image quality such as lines, unevenness and so on can be restrained with more certainty, and a finer high-quality image can be recorded on the sheet.

The controller 100, corresponding to p, D, T that are stored in the IC chip 27 mounted in the head 1, selects one of the plurality of drive signals stored in the ROM 100*b* for each ejection. In this structure, degrading in image quality due to the shifts of ink droplets in the flying directions of ink droplets can be more effectively restrained.

The controller 100 controls the actuator unit 21 by using the three drive signals different in the ejection periods T from each other. Further, the controller 100 controls the actuator unit 21 by selecting one drive signal of the three drive signals. In this structure, by using many drive signals, the flying directions of ink droplets can be changed in a various way, so that degrading in image quality due to the shifts of ink droplets in the flying directions of ink droplets can be more certainly restrained.

The controller 100, for each amount of ink droplets forming one pixel (i.e., for each gradation), controls the actuator unit 21 by using the plurality of drive signals different from each other. In this structure, in a case of gradation recording, degrading in image quality due to the shifts of ink droplets in the flying directions of ink droplets can be restrained.

The controller 100 randomly selects one of the plurality of drive signals for each ejection. In this structure, although there is no such an operation performed that degradation in image quality such as lines and unevenness is detected from test image, degrading in image quality due to the shifts of ink droplets in the flying directions of ink droplets can be restrained.

Hereinafter, the present invention will be more specifically described with the specific example.

In the specific example, a plurality of heads 1 different in the value of p/D from each other are prepared, and in each head 1, the actuator unit 21 is controlled by using the plurality of drive signals different in the ejection periods T from each other (drive signals corresponding to a gradation of medium), and the total amount of shifts y (=y1+y2) of the ink droplets I at the distance x (=1 mm) from the ejection surface 1*a* is measured. Measurement results are shown in FIGS. 9, 7 and 8. Each of the graphs of FIGS. 7, 8 is graphically illustrated based on numerical values of FIG. 9. In FIG. 9, a diameter D of an incoming opening (one opening opposite to the ejection opening 108) of the nozzle hole 107 and the total amount of shifts y are average values with respect to each head 1.

Figure 7A:
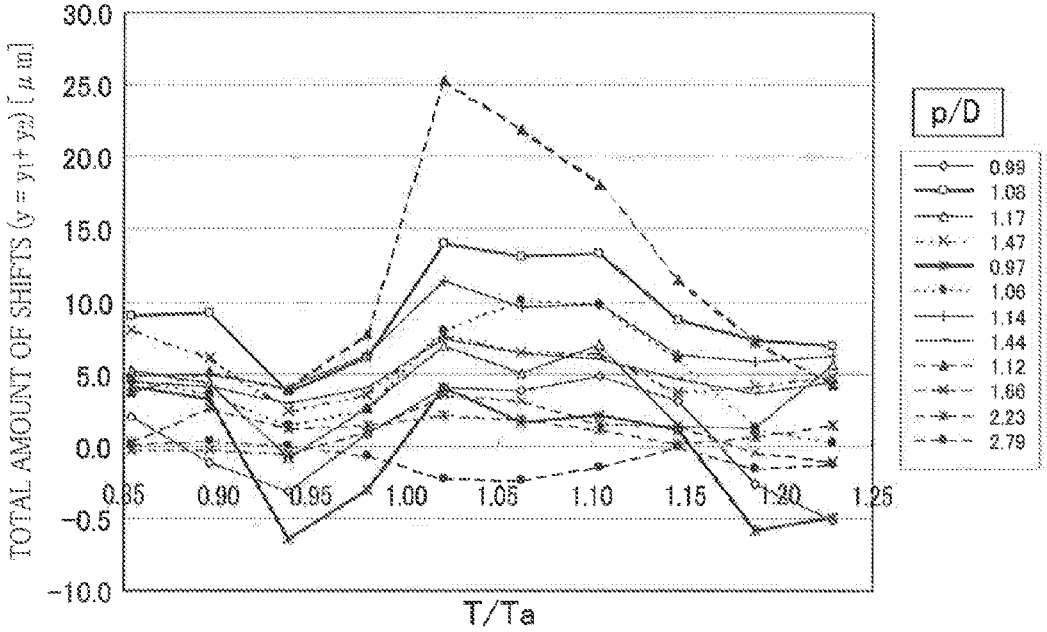
FIGS. 7A and 7B are graphs showing measurement results of a specific example of the present invention.
Figure 7B:
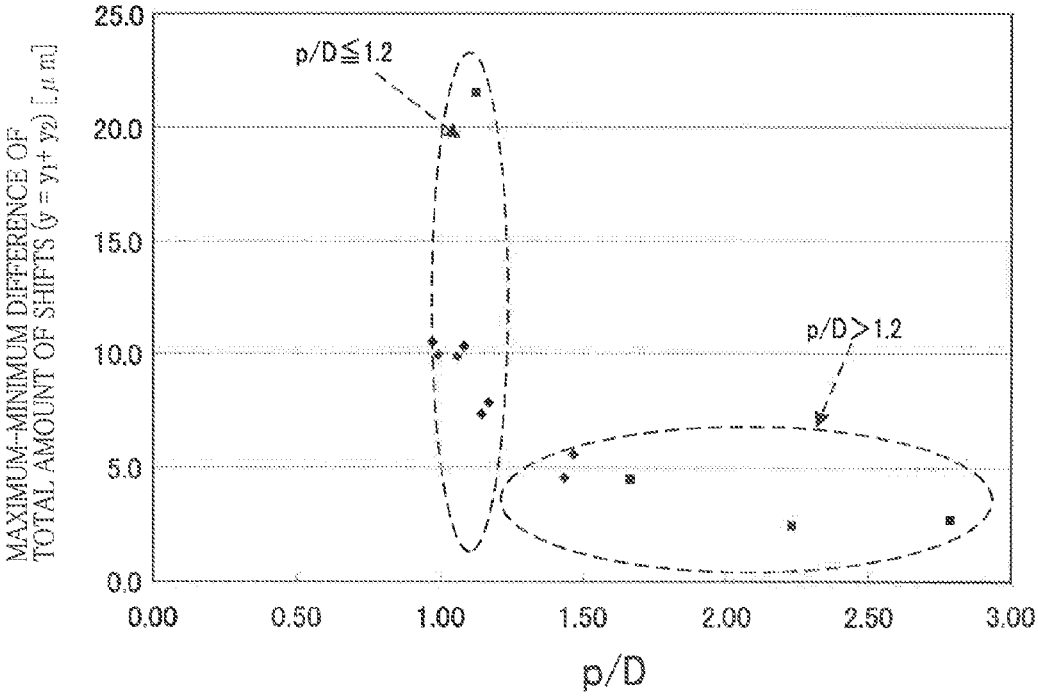

FIG. 7A indicates that the total amount of shifts y changes depending on the ejection periods T, i.e., the flying directions of the ink droplets I change depending on the ejection periods T. Further, FIGS. 8A, 8B indicates that, in the case of p/D≤1.2, changes in the total amounts of shift y are large in most of the ejection periods T, i.e., the shifts of the ink droplets I in the flying directions are large. Therefore, as shown in FIG. 7B, in the case of p/D≤1.2, a difference between maximum and minimum of the total amount of shifts y is large, i.e., an amount of changes of the ink droplets I in the flying directions depending on the ejection periods T is large. The above-described phenomena occurring in the case of p/D≤1.2 can be explained due to interference between the nozzle holes 107. In the present embodiment, the nozzle holes 107 are formed by press working to the nozzle plate. Therefore, as the distance between respective centers of the two ejection openings 108 decreases compared to the diameter D of the incoming opening of the nozzle hole 107, distortion of the nozzle plate 130 occurs during the press working, leading to loss of parallelism between axis lines of the respective nozzle holes 107 (loss of telecentricity in ejection). In the press working, since holes adjacent to each other are made in order, a distance of axis lines of the holes has a tendency to become large in a downward direction comparing to desired axis lines of the holes. Further, in the vicinity of T=Ta, intensity of pressure wave in the individual channel 132 is large, so that ejection characteristics is easily influenced by the distortion.

Figure 8A:
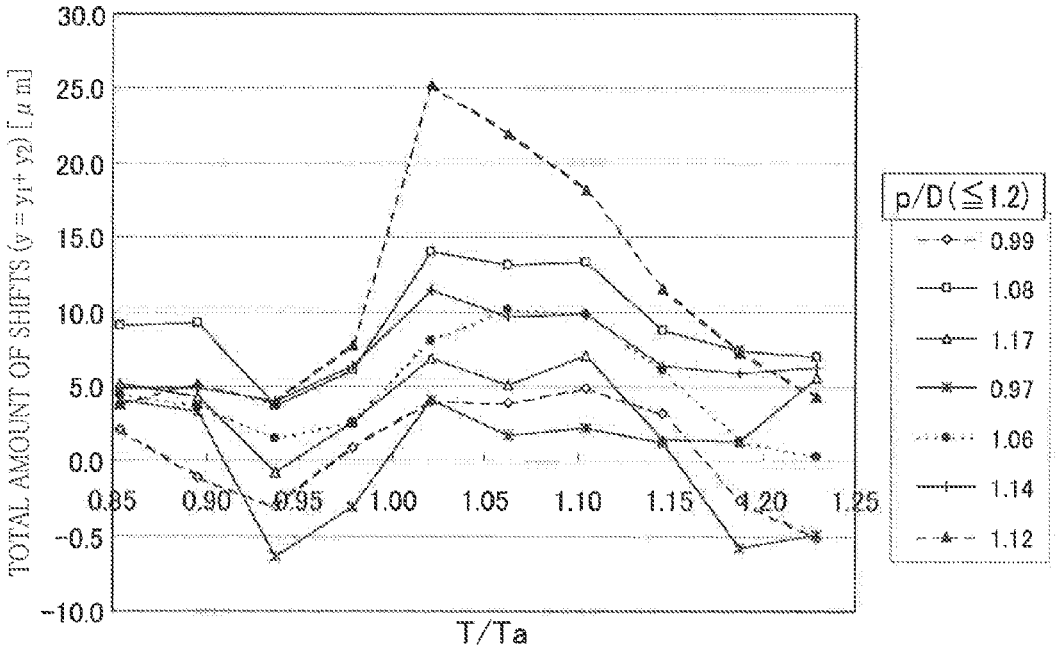
FIGS. 8A and 8B are graphs showing measurement results of a specific example of the present invention.
Figure 8B:
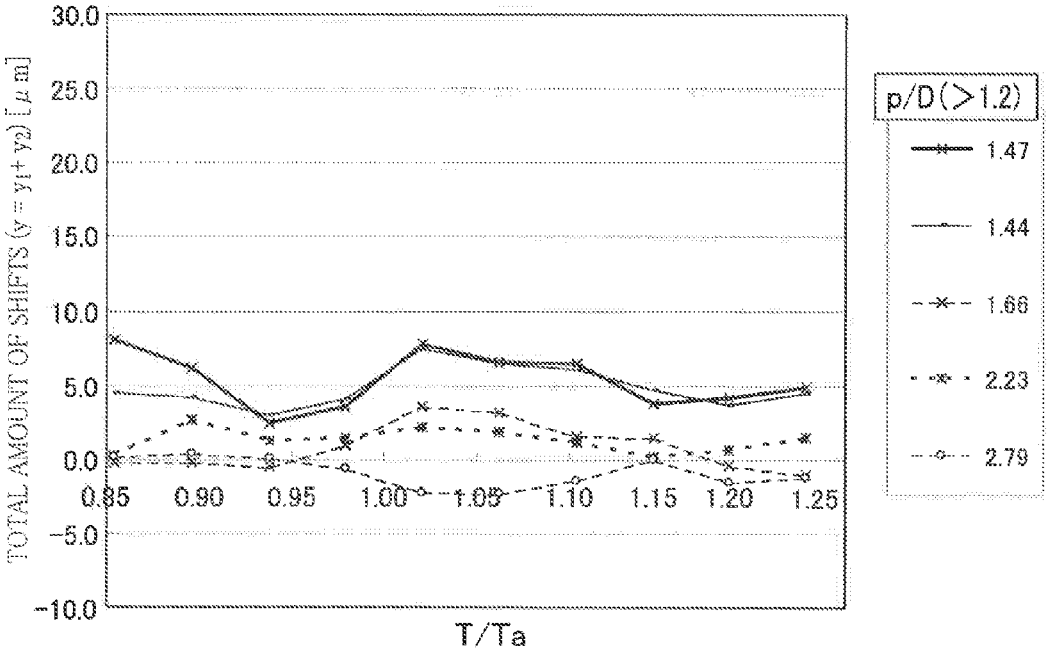

On the other hand, in the case of p/D>1.2, FIGS. 8A, 8B shows that the total amounts of shifts y are small in most of the ejection periods T, i.e., the shifts of the ink droplets I in the flying directions are small. Further, FIG. 7B shows that, in the case of p/D>1.2, a difference between maximum and minimum of the total amount of shifts y is also small, i.e., an amount of changes of the ink droplets I in the flying directions depending on the ejection periods T is small.

Furthermore, FIG. 8A shows that, in the case of p/D≤1.2, within a range of 0.85Ta≤T≤0.9Ta or 1.2 Ta≤T, the total amount of shifts y (=ya) is relatively small and generally constant with respect to the ejection period T. Within a range of 0.9Ta<T<1.2Ta, changes in the total amount of shifts y with respect to the ejection period T is relatively large. Therefore, in this range, a difference between maximum and minimum of the total amount of shifts y is large. Specifically, within a range of 0.9Ta<T≤0.98Ta, the total amount of shifts is the total amount of shifts yb that is smaller than the total amount of shifts ya, and, within a range of 0.98Ta<T<1.2Ta, the total amount of shifts is the total amount of shifts yc that is larger than the total amount of shifts ya.

In all heads 1 used in the specific example, a thickness of the nozzle plate 130 is 30 μm and a taper angle θ of the nozzle hole 107 is 19.7°. Further, all heads 1 used in the specific example are generally the same in channel structure and the values AL, Ta. In the specific example, although influence on measurement results due to difference in channel structure is not considered, it is supposed that, in a case where the value Ta is acquired, which depends on the channel structure, the similar results as in the specific example can be obtained based on the value Ta.

The present invention is not limited to the illustrated embodiment. It is to be understood that the present invention may be embodied with various changes and modifications that may occur to a person skilled in the art, without departing from the spirit and scope of the invention defined in the appended claims.

The controller is not limited to randomly selecting one of the plurality of drive signals. For example, the controller may detect degradation in image quality from test image and select one drive signal for each ejection based on the detected result. Further, the controller is not limited to use of the plurality of drive signals different from each other for each liquid droplet forming one pixel. For example, in a case where the number of gradation is two or more, the controller may use a plurality of drive signals only in one gradation. Furthermore, the number of drive signals that are different in the ejection periods from each other, which is used in the one gradation, is not limited to three, and may be two or more. For example, the controller may control the energy-applying portion by using the first drive signal and either one of the third drive signal and the fourth drive signal. Further, in the illustrated embodiment, although, in the first drive signal, T equals 1.2 Ta, the first drive signal may be within the range of 0.85Ta≤T≤0.9Ta or 1.2 Ta≤T. In the illustrated embodiment, although T equals 0.95 Ta in the third drive signal, the third drive signal may be within the range of 0.9Ta<T≤0.98Ta. In the illustrated embodiment, although T equals 1.056Ta in the fourth drive signal, the third signal may be within the range of 0.98Ta<T<1.2Ta. Furthermore, in a case where the edges of image are formed, the controller may control the energy-applying portion by using a plurality of drive signals. The energy-applying portion is not limited to piezoelectric-type, but may be another type such as thermal-type in which a heating element is used, electrostatic-type in which electrostatic force is used, and so on. Furthermore, the number of ejection openings constituting the ejection opening group is not limited to two, but may be three or more. It is not limited that the ejection openings constituting the ejection opening group are aligned in the main scanning direction, but the ejection openings may be arranged in an inclined direction with respect to the main scanning direction. The channel structure including the individual channels in the liquid ejection head can be properly changed. Further, the number of the liquid ejection head disposed in the liquid ejection apparatus may be any number that is one or more. The liquid ejection head may eject any liquid other than ink. Furthermore, the liquid ejection head is not limited to line-type, but may be serial-type. The liquid ejection apparatus is not limited to the printer, but may be a facsimile machine, a copier machine, and so on. Moreover, the recording medium is not limited to the sheet, but may be any medium that is recordable.

What is claimed is:

1. A liquid ejection apparatus comprising a liquid ejection head including:

a plurality of ejection opening groups each constituted by two or more ejection openings and each configured to form one pixel by at least two liquid droplets ejected from the two or more ejection openings of a corresponding one of the plurality of ejection opening groups;

a plurality of individual channels configured to respectively connect the plurality of ejection opening groups to a plurality of pressure chambers; and an energy-applying portion configured to apply energy to liquid in the plurality of pressure chambers such that the liquid droplets are ejected from at least one ejection opening group selected among the plurality of ejection opening groups, and a controller configured to control the energy-applying portion, wherein, in a case where a first recording period is defined as a time period required for a recording medium to move relatively to the liquid ejection head by a unit length corresponding to resolution of an image recorded on the recording medium, the controller controls the energy-applying portion to form one pixel by using at least (a) a first drive signal in which an ejection period of the liquid droplets ejected in the first recording period is a first ejection period, and (b) a second drive signal in which an ejection period of the liquid droplets ejected in the first recording period is a second ejection period different from the first ejection period.

2. The liquid ejection apparatus according to claim 1, wherein, when an area of the image except edges thereof is recorded, the controller controls the energy-applying portion by using at least the first drive signal and the second drive signal.

3. The liquid ejection apparatus according to claim 1, wherein the liquid ejection head includes a nozzle plate through which a plurality of nozzle holes, each having the two or more ejection openings at an end thereof, extend, each of the plurality of ejection opening groups comprising two ejection openings formed adjacent to each other in the nozzle plate, wherein the controller controls the energy-applying portion to form one pixel by using at least the first drive signal and the second drive signal, in a case where the following relation is met:

$$p/D \leq 1.2$$

where p is a distance between respective centers of the two ejection openings of the ejection opening group, the two ejection openings being formed on an ejection surface of the nozzle plate, and D is a diameter of an opening of each of the nozzle holes corresponding to the two ejection openings of the ejection opening group, the opening being formed on a surface opposite to the ejection surface of the nozzle plate.

4. The liquid ejection apparatus according to claim 3, wherein the first ejection period T1 in the first drive signal is $0.85Ta \leq T1 \leq 0.9Ta$ or $1.2Ta \leq T1$, and the second ejection period T2 in the second drive signal is $0.9Ta < T2 < 1.2Ta$, where Ta is a resonance period of the individual channel.

5. The liquid ejection apparatus according to claim 4, wherein the second drive signal includes a third drive signal, in which an ejection period T3 of the liquid droplet is $0.9Ta < T3 \leq 0.98Ta$, and a forth drive signal, in which an ejection period T4 of the liquid droplet is $0.98Ta < T4 < 1.2Ta$.

6. The liquid ejection apparatus according to claim 3, further comprising:

an input portion by which the p, D and Ta are inputted; and a storing portion configured to store a plurality of drive signals including the first drive signal and the second drive signal, wherein the controller controls, based on the p, D and Ta inputted by the input portion, the energy-applying portion to form one pixel by selecting one of the plurality of drive signals stored in the storing portion for each liquid ejection.

7. The liquid ejection apparatus according to claim 1, wherein the controller controls the energy-applying portion to form one pixel by using at least three drive signals which includes the first drive signal and the second drive signal, the three drive signals having respective three ejection periods of the liquid droplet different from each other.

8. The liquid ejection apparatus according to claim 1, wherein the controller controls the energy-applying portion to a first ejection opening group and a second ejection opening group corresponding to two pixels different from each other in an amount of ejection liquid by using at least two drive signals having respective ejection periods different from each other, based on the respective amounts of the two pixels.

9. The liquid ejection apparatus according to claim 1, wherein the controller controls the energy-applying portion by randomly selecting one of the plurality of drive signals including the first drive signal and the second drive signal for each liquid ejection.

* * * * *